US012638269B2

(12) United States Patent
Klos

(10) Patent No.: US 12,638,269 B2
(45) Date of Patent: May 26, 2026

(54) WEARABLE DEVICE FOR ONE-HANDED RELOADING OF A FIREARM

(71) Applicant: Nicholas Gerard Klos, Colorado Springs, CO (US)

(72) Inventor: Nicholas Gerard Klos, Colorado Springs, CO (US)

( * ) Notice: Subject to any disclaimer, the term of this patent is extended or adjusted under 35 U.S.C. 154(b) by 0 days.

(21) Appl. No.: 19/382,841

(22) Filed: Nov. 7, 2025

(65) Prior Publication Data

US 2026/0133010 A1 May 14, 2026

Related U.S. Application Data

(60) Provisional application No. 63/718,071, filed on Nov. 8, 2024.

(51) Int. Cl.
*F41C 33/00* (2006.01)
*A45F 5/02* (2006.01)

(52) U.S. Cl.
CPC ..... *F41C 33/008* (2013.01); *A45F 5/021* (2013.01)

(58) Field of Classification Search
CPC .. F41C 33/0281; F41C 33/008; F41C 33/006; F41C 27/00; F41C 33/0236; F41C 33/0245; F41C 33/0354; A45F 5/021; F41A 9/83; F41A 9/84
USPC ..... 224/269
See application file for complete search history.

(56) References Cited

U.S. PATENT DOCUMENTS

| | | | | |
|---|---|---|---|---|
| 5,937,559 | A | 8/1999 | Jennen | |
| 6,510,642 | B2 | 1/2003 | Riener | |
| 6,726,072 | B2 * | 4/2004 | Rugh | F41C 33/008 42/106 |
| 8,438,774 | B2 * | 5/2013 | Sharp | F41C 27/00 42/90 |
| 9,121,662 | B1 * | 9/2015 | Love | F41C 27/00 |
| 9,395,153 | B2 | 7/2016 | Bottrell | |
| 9,404,696 | B2 | 8/2016 | Karimullah et al. | |
| 9,476,670 | B2 * | 10/2016 | Parsons | A45F 5/021 |
| 9,618,298 | B2 | 4/2017 | Karimullah et al. | |
| 9,685,265 | B2 | 6/2017 | Stutz | |
| 9,927,218 | B1 | 3/2018 | Schlang | |
| 9,933,218 | B2 | 4/2018 | Butler | |
| 10,175,014 | B2 | 1/2019 | Kim | |
| 11,619,464 | B2 * | 4/2023 | Cerda | B60R 7/14 248/205.3 |
| 11,740,048 | B2 * | 8/2023 | Featherston, Jr. | F41A 23/18 42/94 |
| 11,986,083 | B2 | 5/2024 | Stutz | |

(Continued)

*Primary Examiner* — Adam J Waggenspack
(74) *Attorney, Agent, or Firm* — The Webb Law Firm

(57) ABSTRACT

A wearable device for supporting a firearm during one-handed reloading includes an elongated body having an upper portion and a recessed lower portion extending downward from the upper portion. The upper portion includes a shelf configured to receive a proximal sight of the firearm for supporting the firearm against the elongated body. The wearable device also includes at least one magnet disposed in or against the upper portion configured to retain the sight against the shelf and at least one clip on a rear surface of the elongated body for securing the wearable device to a garment of an individual. A method for one-handed reloading of a firearm including an initial step of attaching the wearable device to the garment of the individual with the at least one clip is also disclosed herein.

20 Claims, 12 Drawing Sheets

(56) References Cited

U.S. PATENT DOCUMENTS

| | | | | |
|---|---|---|---|---|
| 12,347,615 | B1 * | 7/2025 | Xu | F16M 13/02 |
| 12,429,319 | B1 | 9/2025 | MacFarlane | |
| 2009/0001117 | A1 | 1/2009 | Rassias | |
| 2015/0241168 | A1 * | 8/2015 | Wilson | F41C 33/0236 224/243 |
| 2015/0260479 | A1 | 9/2015 | Aravena | |
| 2017/0191795 | A1 * | 7/2017 | Xia | F41C 33/0263 |
| 2018/0010871 | A1 | 1/2018 | Bressler | |
| 2020/0348105 | A1 | 11/2020 | Gill et al. | |
| 2025/0057302 | A1 * | 2/2025 | Chambers | A45F 5/021 |
| 2025/0060203 | A1 | 2/2025 | Perlman et al. | |

* cited by examiner

WEARABLE DEVICE FOR ONE-HANDED RELOADING OF A FIREARM

CROSS REFERENCE TO RELATED APPLICATION

This application claims the benefit of U.S. Provisional Patent Application No. 63/718,071, filed on Nov. 8, 2024, the disclosure of which is hereby incorporated by reference in its entirety.

BACKGROUND OF THE INVENTION

Field of the Invention

The present disclosure relates to accessory devices for use with firearms and, in particular, to wearable devices configured to be attached to clothing for supporting the firearm allowing an individual to reload the firearm with one hand. The present disclosure is also directed to methods of using the device for reloading the firearm in a safe and efficient manner with only one hand, as may be required when the individual is injured limiting his or her ability to manipulate the firearm with both hands.

Description of Related Art

In most instances, a firearm user reloads his or her firearm using both hands. For example, the user may hold the firearm in a dominant hand and use the non-dominant hand to insert a new magazine into the firearm. However, in some situations, the user may need to reload his or her firearm with only one hand if, for example, one of the user's hands is injured or otherwise unable to perform a reloading action.

Current training for reloading a firearm with one hand instructs users to support the firearm against a part of their body or clothing while replacing the firearm magazine. For example, as shown in FIG. 1A, an individual or user 2 with an injured arm 3 may be instructed to support a firearm 4 by placing it between his or her knees 6 during one-handed reloading. However, in order to reload a firearm in this position, the user 2 must look down to insert the magazine into the firearm 4 giving a target or suspect an opportunity to move or act while the user's view and attention are diverted. Also, during reloading in this position, the individual or user cannot move until the firearm 4 is reloaded and removed from between his or her knees 6 making it more difficult to quickly change position or follow a fleeing target.

As shown in FIG. 1B, another conventional option for one-handed reloading is to support the firearm 4 behind one of the individual's knees 6. In order to move to this position, the individual must kneel down and look downward to correctly position the new magazine in the firearm 4. In this position, the user 2 is immobile until the firearm 4 is removed from behind the knee 6.

As shown in FIG. 1C, another option is to place the firearm 4 in an opposite holster 8 for reloading. However, in order to move to this position and as shown in FIG. 1C, the user 2 must reach across his or her body to manipulate the firearm 4. Overreaching in this manner can be awkward and uncomfortable for the user 2, especially when one of the user's arms 3 is already injured. Also, the firearm 4 can fall out of the holster 8 especially if other accessories, such as a flashlight, are already attached to the firearm 4, making it harder to insert the firearm 4 into the holster 8. In some instances, individuals may also be instructed to insert the firearm 4 into a portion of a garment or pocket while reloading with one hand. However, finding a pocket or portion of a garment that is a correct size and position to receive the firearm 4 can be difficult, especially if the individual is trying to quickly reload the firearm 4 and/or needs to monitor a target or suspect while reloading.

One-handed reloading can be even more difficult when an injured user 2 is on the ground and unable to stand up. In particular, the injured user 2 may be unable to move his or her body to a suitable position for supporting the firearm 4 between the knees 6 or behind a knee 6, as shown in FIGS. 1A and 1B. The injured user 2 also may not be able to twist or move in order to insert the firearm 4 into a holster 8 (shown in FIG. 1C) or portion of clothing to support the firearm 4 for reloading. Therefore, in such scenarios, the injured user 2 may have few options for one-handed reloading of the firearm.

In view of these difficulties with conventional techniques for one-handed reloading, there is a need in the art for improved accessory devices and methods for simplifying reloading actions. Such devices and methods desirably would allow for fast and efficient reloading of the firearm with one hand and without limiting the firearm user's ability to move or requiring the user 2 to look away from a target for any amount of time. The devices and methods of the present disclosure are configured to address these issues in order to improve one-handed firearm reloading techniques.

SUMMARY OF THE INVENTION

According to an aspect of the disclosure, a wearable device for supporting a firearm during one-handed reloading includes an elongated body having an upper portion and a recessed lower portion extending downward from the upper portion. The upper portion includes a shelf configured to receive a proximal sight of the firearm for supporting the firearm against the elongated body. The wearable device also includes at least one magnet disposed in or against the upper portion configured to retain the sight against the shelf and at least one clip on a rear surface of the elongated body for securing the wearable device to a garment of an individual.

According to another aspect of the disclosure, a method for one-handed reloading of a firearm includes an initial step of attaching the previously described wearable device to the garment of the individual with the at least one clip. The method also includes steps of positioning the proximal sight of the firearm against the shelf of the upper portion with the at least one magnet retaining the proximal sight against the shelf, thereby securing the firearm to the elongated body and, with the firearm secured to the elongated body, reloading the firearm with one hand.

According to another aspect of the disclosure, a wearable garment includes the wearable device, as previously described, secured to the garment by the at least one clip.

Preferred and non-limiting examples of the present disclosure will now be described in the following numbered clauses:

Clause 1: A wearable device for supporting a firearm during one-handed reloading, the device comprising: an elongated body comprising an upper portion and a recessed lower portion extending downward from the upper portion, the upper portion comprising a shelf configured to receive a proximal sight of the firearm for supporting the firearm against the elongated body; at least one magnet disposed in or against the upper portion configured to retain the sight against the shelf;

and at least one clip on a rear surface of the elongated body for securing the wearable device to a garment of an individual.

Clause 2: The wearable device of clause 1, wherein the upper portion of the elongated body comprises the shelf, a front surface, a rear surface, and side surfaces extending between the front surface and the rear surface.

Clause 3: The wearable device of clause 2, wherein the lower portion of the elongated body comprises a front surface recessed relative to the front surface of the upper portion, a rear surface that is continuous with the rear surface of the upper portion, and side surfaces extending therebetween, which are continuous with the side surfaces of the upper portion.

Clause 4: The wearable device of clause 3, wherein a thickness of the lower portion between the front surface and the rear surface thereof is at least 0.25 inch less than a thickness of the upper portion between the front surface and the rear surface of the upper portion.

Clause 5: The wearable device of any of clauses 1-3, wherein a length of the elongated body matches or substantially matches a length of a barrel of the firearm.

Clause 6: The wearable device of any of clauses 1-5, wherein the lower portion is recessed relative to the upper portion by a distance corresponding to a height of a distal sight extending upwards from a barrel of the firearm.

Clause 7: The wearable device of any of clauses 1-6, wherein the elongated body has a length between the shelf of the upper portion and a bottom surface of the lower portion of about 5 inches to about 8 inches, preferably about 6 inches to about 6.5 inches.

Clause 8: The wearable device of any of clauses 1-7, wherein the elongated body comprises a rigid plastic, such as polycarbonate.

Clause 9: The wearable device of any of clauses 1-8, wherein the shelf of the upper portion is substantially rectangular with a length of about 1.5 inches to 2 inches in one dimension and about 1.0 inch to about 1.3 inches in a second dimension.

Clause 10: The wearable device of any of clauses 1-9, wherein the magnet is positioned to secure the proximal sight of the firearm against the shelf of the upper portion of the elongated body with a handle of the firearm oriented away from the individual.

Clause 11: The wearable device of any of clauses 1-10, wherein the at least one magnet comprises a neodymium magnet.

Clause 12: The wearable device of any of clauses 1-11, further comprising a magnet housing containing the magnet and connected to the upper portion with an open top end of the magnet housing substantially flush with the shelf of the upper portion.

Clause 13: The wearable device of any of clauses 1-12, wherein the at least one clip comprises a Molle-Lok attachment.

Clause 14: The wearable device of any of clauses 1-13, wherein the at least one clip comprises a stationary member secured to rear surfaces of the upper and/or lower portions of the elongated body, and an articulating member configured to pivot relative to the stationary member for securing a portion of the garment between the stationary member and articulating member, thereof securing the wearable device to the garment.

Clause 15: The wearable device of any of clauses 1-14, further comprising at least one guide fin extending upwards from the shelf of the upper portion of the elongated body.

Clause 16: The wearable device of clause 15, wherein the at least one guide fin is configured for removing a double feed malfunction from the firearm where a spent round remains stuck in a chamber of the firearm.

Clause 17: The wearable device of any of clauses 1-16, further comprising a first guide fin extending upwards from a right edge of the shelf and a second guide fin extending upwards from a left edge of the shelf.

Clause 18: The wearable device of clause 17, wherein the first guide fin and the second guide fin are configured to guide the proximal sight to the shelf for supporting the firearm.

Clause 19: The wearable device of clause 18, wherein the first guide fin and the second guide fin are configured for removing a double feed malfunction from the firearm where a spent round remains stuck in a chamber of the firearm.

Clause 20: A method for one-handed reloading of a firearm, the method comprising: attaching the wearable device of any of clauses 1-19 to the garment of the individual with the at least one clip; positioning the proximal sight of the firearm against the shelf of the upper portion with the at least one magnet retaining the proximal sight against the shelf, thereby securing the firearm to the elongated body; and with the firearm secured to the elongated body, reloading the firearm with one hand.

Clause 21: The method of clause 20, wherein the firearm is secured to the elongated body with a handle of the firearm extending away from the individual.

Clause 22: The method of clause 20 or clause 21, wherein the garment comprises a utility vest.

Clause 23: The method of any of clauses 20-22, wherein the firearm comprises a 9 mm semi-automatic pistol and the sight comprises a red dot sight.

Clause 24: The method of any of clauses 20-23, further comprising selecting the wearable device from a plurality of available wearable devices of different sizes so that a length of the selected wearable device substantially matches a length of a barrel of the selected firearm.

Clause 25: The method of any of clauses 20-24, wherein when the firearm is secured to the elongated body, the firearm is spaced apart from the garment preventing the firearm from contacting or attaching to a portion of the garment.

Clause 26: A wearable garment comprising the wearable device of any of clauses 1-19 secured to the garment by the at least one clip.

Clause 27: The wearable garment of clause 26, comprising a utility vest.

Clause 28: The wearable garment of clause 26, further comprising one or more pockets for replacement magazines for the firearm.

BRIEF DESCRIPTION OF THE DRAWINGS

The disclosure will be described with reference to the following drawing figures wherein like reference numbers identify like parts throughout.

DESCRIPTION OF THE INVENTION

Figure 1A:
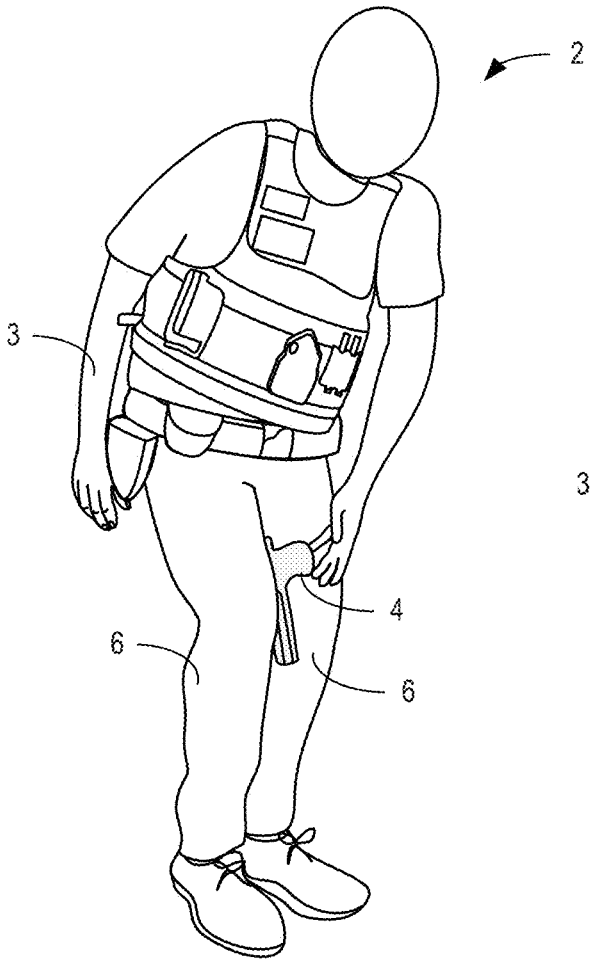
FIGS. 1A-1C are drawings showing an individual or user with an injured arm positioning a firearm in different positions that are commonly used for one-handed reloading of the firearm, as are known in the prior art.
Figure 1B:
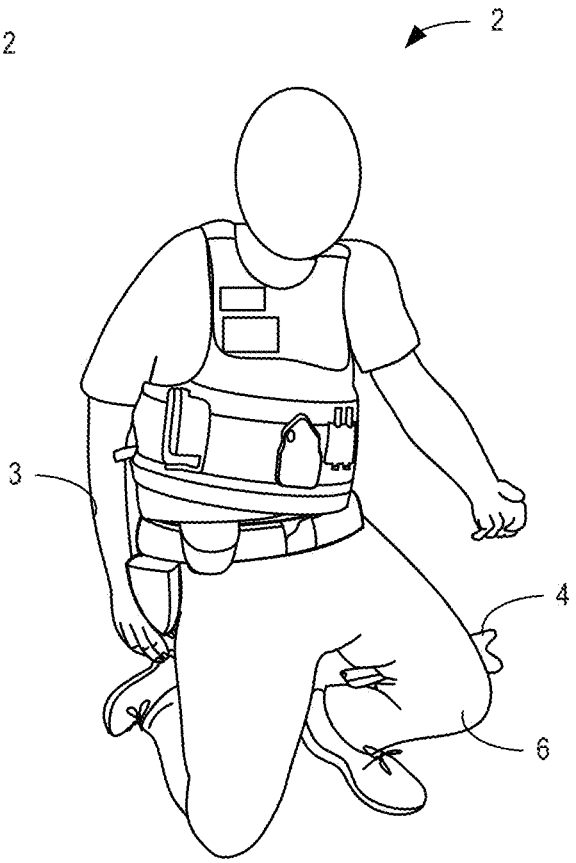
Figure 1C:
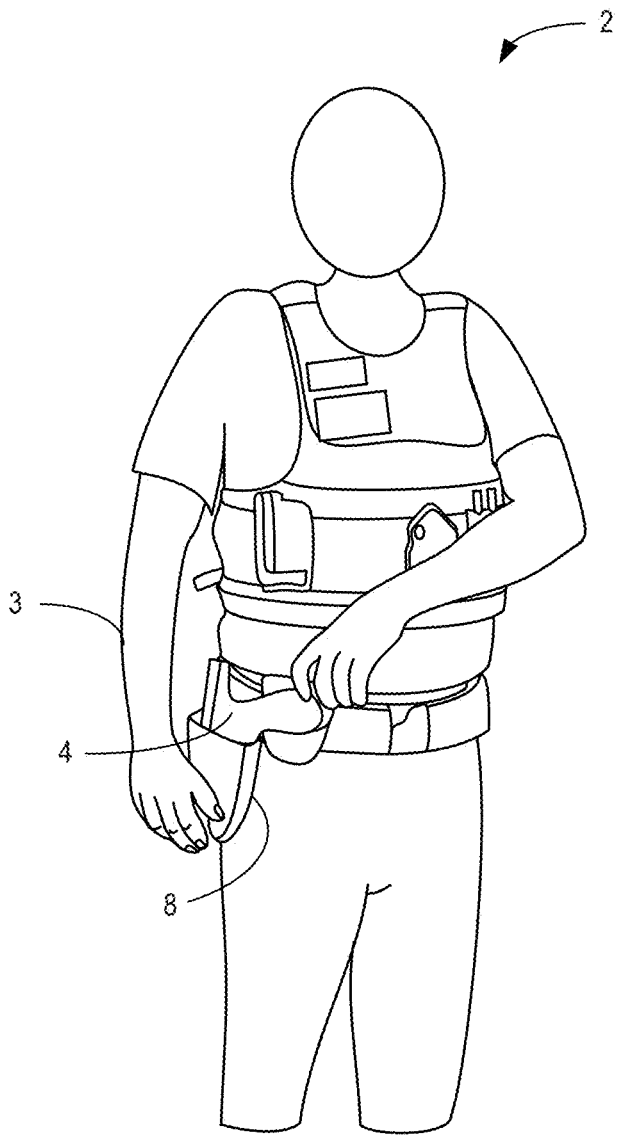

As used herein, the singular form of "a", "an", and "the" include plural referents unless the context clearly states otherwise.

As used herein, the terms "right", "left", "top", "bottom", and derivatives thereof shall relate to the invention as it is oriented in the drawing figures. The term "proximal" refers to a portion or end of an implement or tool, such as a firearm, that is manipulated or held by a user. The term "distal" refers a portion or end of an implement or tool that is opposite from the proximal portion or end and is farthest away from the portion of the implement or tool manipulated or held by the user. However, it is to be understood that the invention can assume various alternative orientations and, accordingly, such terms are not to be considered as limiting. Also, it is to be understood that the invention can assume various alternative variations and stage sequences, except where expressly specified to the contrary. It is also to be understood that the specific devices and processes illustrated in the attached drawings, and described in the following specification, are examples. Hence, specific dimensions and other physical characteristics related to the embodiments disclosed herein are not to be considered as limiting.

For the purposes of this specification, unless otherwise indicated, all numbers expressing, for example, dimensions, physical characteristics, and so forth used in the specification and claims are to be understood as being modified in all instances by the term "about." Unless indicated to the contrary, the numerical parameters set forth in the following specification and attached claims are approximations that can vary depending upon the desired properties sought to be obtained by the present invention. Notwithstanding that the numerical ranges and parameters setting forth the broad scope of the invention are approximations, the numerical values set forth in the specific examples are reported as precisely as possible. Any measured numerical value, however, may inherently contain certain errors resulting from the standard deviation found in their respective testing measurements.

As used herein, the terms "comprising," "comprise" or "comprised," and variations thereof, are meant to be open ended.

Also, it should be understood that any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1.

With reference to the figures, the present disclosure is directed to an accessory device, referred to herein as a wearable device 10, for use with a firearm 110, such as a semi-automatic pistol or similar weapon, and configured to support the firearm 110. The wearable device 10 is configured to be wearable, including a clip, bracket, button, or similar fastener for securing the wearable device 10 to a garment 112, such as a utility or police vest (shown in FIGS. 6A-6C), worn, for example, by law enforcement officers, military personnel, or similar professionals trained in firearm use. The wearable device 10 is configured to support the firearm 110 providing space or barrier between the firearm 110 and the garment 112 in order to prevent the firearm 110 from catching or attaching to portions of the garment 112. Furthermore, the wearable device 10 is designed to allow the user to reload the firearm 110 with one hand and without limiting mobility. Also, the wearable device 10 is designed to be easy to learn to use and highly customizable. For example, the user can attach the wearable device 10 to any convenient location on his or her clothing depending on personal preference and/or physical characteristics (e.g., right or left handed). The wearable device 10 also desirably keeps the firearm 110 within a user's comfortable workspace during reloading meaning that the user is not required to reach across his or her body or move to another awkward position in order to reload the firearm 110.

In examples, the wearable device 10 is configured for use with a firearm 110 equipped with an optical sight, such as a red dot sight, which comprises a proximal or rear sight extending upwards from a proximal end portion of a barrel of the firearm 110. Furthermore, as described in further detail herein, the wearable device 10 can include guides, such as protrusions or fins, positioned and configured to assist the user in moving the firearm 110 and sight to a correct mounting position on the wearable device 10. In examples, the fins or protrusions can also be used as a tool to strip a magazine if it does not fully eject when attempting a reload. Beneficially, when wearing the device 10, the user does not need to waste time looking for other tools or gear in order to strip magazine(s) that fail to eject correctly. Having a tool for stripping magazines conveniently positioned on the vest or garment 112 means that the user can smoothly transition into the reload allowing the user to execute the reload in a fast and efficient manner.

In examples, the wearable device 10 can also temporarily support the firearm 110 freeing the user's hands to perform other tasks. For example, even after reloading, the firearm 110 can remain secured to the wearable device 10 allowing the user to perform tasks, such as treating his or her injuries or communicating on, for example, a radio or cellular phone. While the firearm 110 is secured to the wearable device 10, the user can also move at a fast pace, such as running or making darting movements in order, for example, to move to a covered position. Beneficially, the user does not need to spend time trying to find a secure place for his or her firearm 110 at times when the user's conventional holster cannot be used, such as when the user's dominant hand/arm is injured making it difficult to holster the firearm 110 in a conventional manner. Furthermore, because the wearable device 10 can be centrally positioned on the user's torso, the wearable device 10 can be used when either the right or left (e.g., dominant or non-dominant) arm or hand is injured.

Figure 2A:
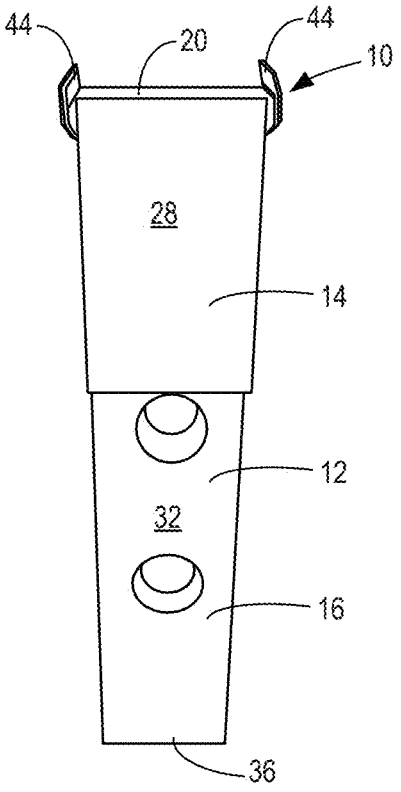
FIG. 2A is a front view of a wearable device for supporting a firearm during one-handed reloading, according to an aspect of the present disclosure.
Figure 2B:
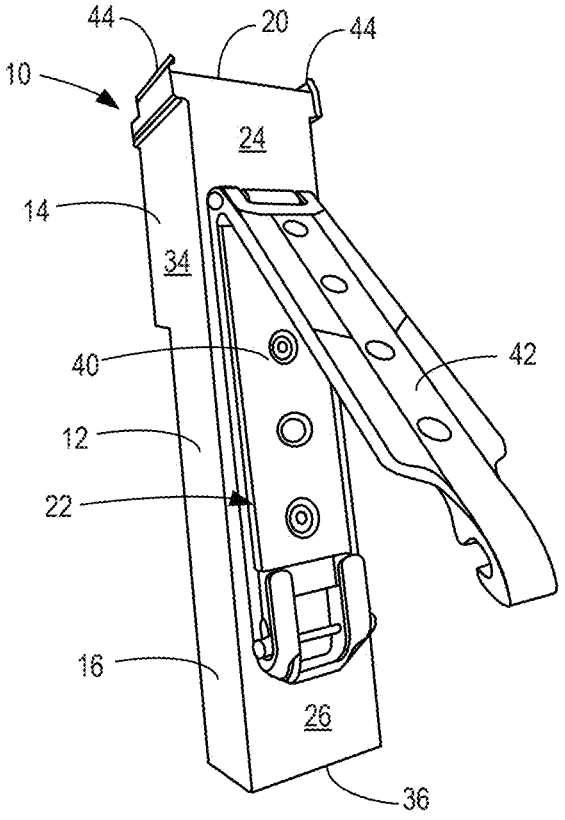
FIG. 2B is a rearwardly directed perspective view of the wearable device of FIG. 2A.
Figure 3A:
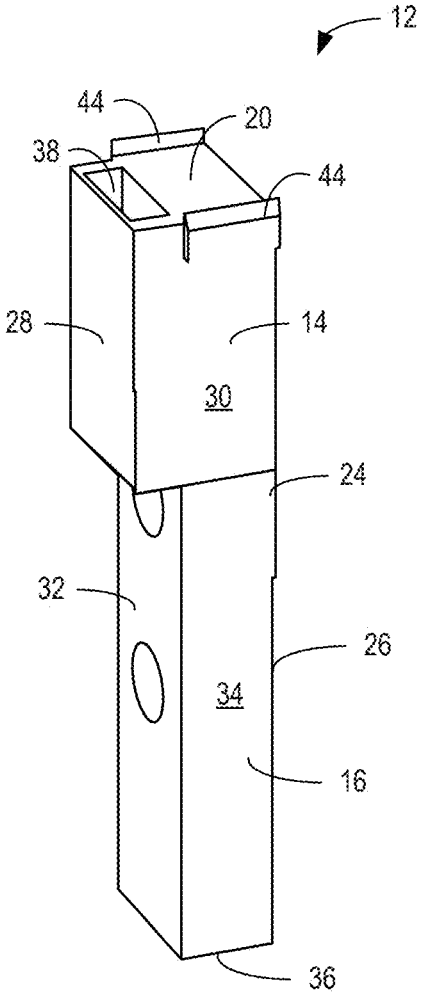
FIG. 3A is a perspective view of an elongated body or body portion of a wearable device for supporting a firearm during one-handed reloading, according to an aspect of the present disclosure.
Figure 3B:
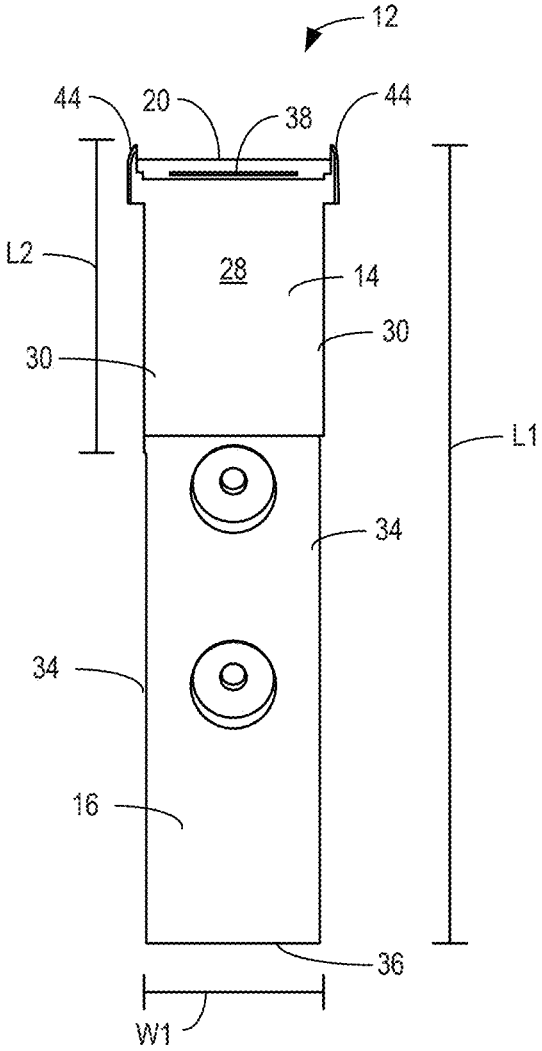
FIG. 3B is a front view of the wearable device of FIG. 3A.
Figure 3C:
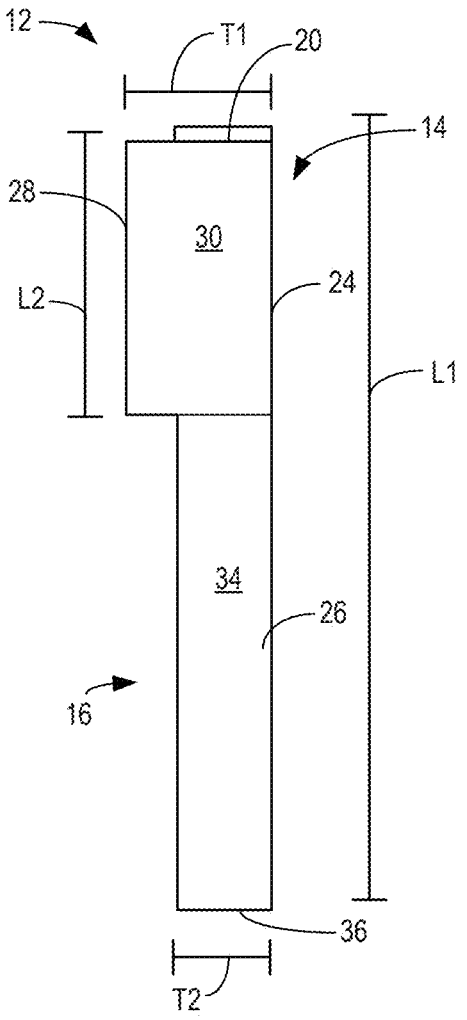
FIG. 3C is a left side view of the wearable device of FIG. 3A.
Figure 3D:
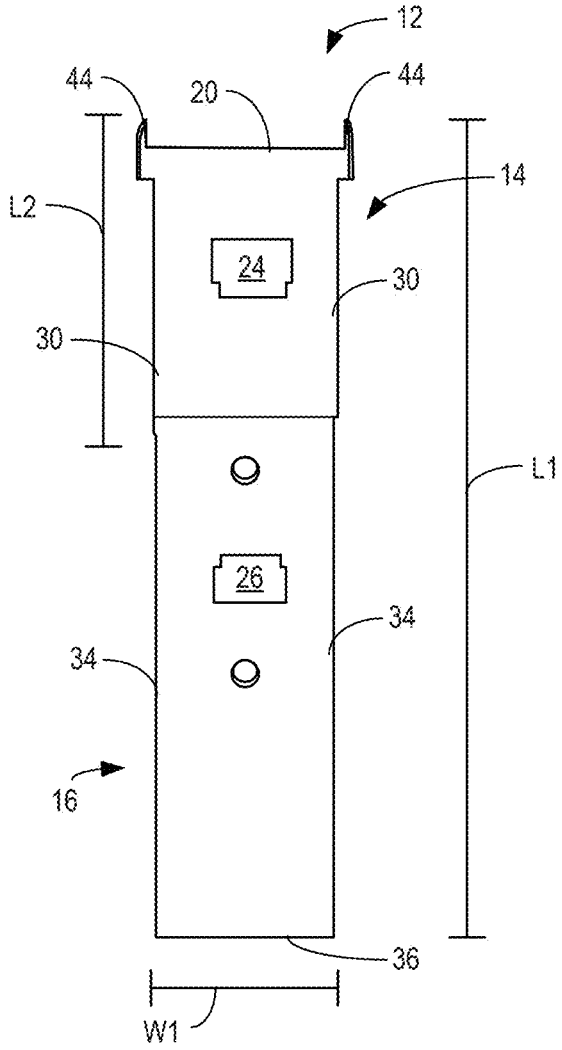
FIG. 3D is a rear view of the wearable device of FIG. 3A.
Figure 3E:
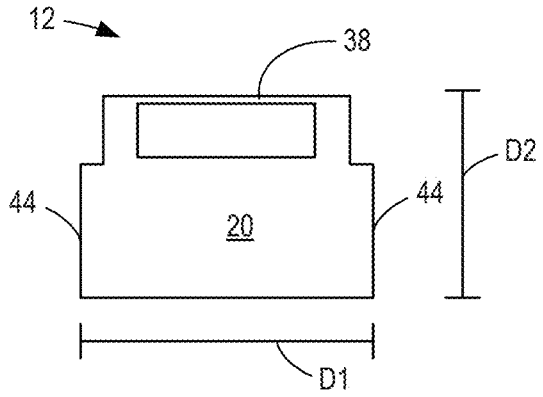
FIG. 3E is a top view of the wearable device of FIG. 3A.
Figure 3F:
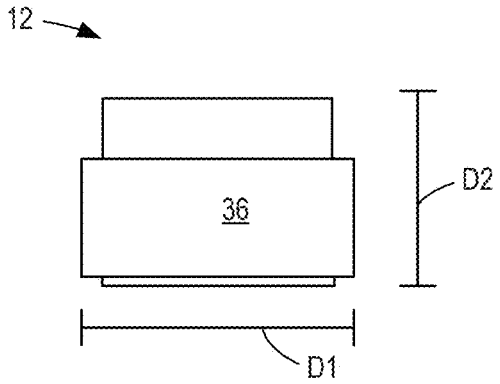
FIG. 3F is a bottom view of the wearable device of FIG. 3A.

FIGS. 2A and 2B show front and rear views of the wearable device 10 for supporting the firearm 110 during one-handed reloading. As shown in FIGS. 2A and 2B, the wearable device 10 comprises an elongated body 12 comprising an upper portion 14 and a recessed lower portion 16 extending below the upper portion 14. The wearable device 10 further comprises a magnet 18 (shown in FIG. 4) disposed on or proximate to a top surface or shelf 20 of the upper portion 14 of the wearable device 10. As described in further detail herein, the top surface or shelf 20 of the elongated body 12 is configured to receive a proximal sight of the firearm 110 for supporting the firearm 110 against the elongated body 12. The wearable device 10 further comprises a clip 22 (shown in FIG. 2B) on a rear surface 24, 26 of the elongated body 12 for securing the wearable device 10 to a garment of an individual or user.

As shown in FIGS. 3A-3F, the elongated body 12 is a generally L-shaped structure including the upper portion 14 which projects outward beyond the lower portion 16 by a distance of at least 0.25 inch, or about 0.2 inch to about 0.5 inch or, preferably, about 0.2 inch to about 0.3 inch. The upper portion 14 of the elongated body 12 can comprise the top surface or shelf 20, a front surface 28, the rear surface 24, and side surfaces 30 extending between the front surface 28 and the rear surface 24. The lower portion 16 of the elongated body 12 can comprise a front surface 32 that is recessed relative to the front surface 28 of the upper portion 14, the rear surface 26 that is continuous with the rear surface 24 of the upper portion 14, and side surfaces 34 extending therebetween. As shown in FIGS. 3A-3F, the side surfaces 34 of the lower portion 16 can be continuous with the side surfaces 30 of the upper portion 14.

As discussed above, in some examples, the lower portion 16 is recessed by at least 0.25 inch relative to the upper portion 14 meaning that a thickness T2 (shown in FIG. 3C) of the lower portion 16 (e.g., between the front surface 32 and the rear surface 26 thereof) is at least about 0.25 inch less than a thickness T1 (shown in FIG. 3C) of the upper portion 14 (e.g., between the front surface 28 and the rear surface 24 of the upper portion 14). The recess distance can be selected to provide space so that portions of the firearm 110, such as a front or distal sight attached to a barrel of the firearm 110, do not press against the wearable device 10 and/or contact or catch the garment or any other items attached to or supported by the garment.

Dimensions of the elongated body 12 can be selected based on the size and type of firearm 110 being secured to the wearable device 10. For a 9 mm semi-automatic pistol, the wearable device 10 can have the following dimensions: a length L1 (shown in FIGS. 3B-3D) between the top surface or shelf 20 of the upper portion 14 and a bottom surface 36 of the lower portion 16 of about 5.0 inches to about 8.0 inches, or preferably about 6.0 inches to about 6.5 inches, or about 6.2 inches; and a width W1 (shown in FIGS. 3B and 3D) of about 1.0 inch to 2.0 inches, preferably about 1.2 inches to about 1.5 inches, or about 1.3 inches. A length L2 (shown in FIGS. 3B-3D) of the upper portion 14 can be about 2.0 inches to 3.0 inches, or preferably about 2.2 inches to 2.5 inches, or about 2.3 inches. The thickness T1 (shown in FIG. 3C) of the upper portion 14 of the elongated body 12 can be about 1.0 inch to about 1.3 inches, or about 1.2 inches, and a thickness T2 (shown in FIG. 3C) of the lower portion 16 of the elongated body 12 can be about 0.5 inch to 1.0 inch, or about 0.8 inch. The top surface or shelf 20 of the elongated body 12 can be rectangular with a length of about 1.5 inches to 2.0 inches or about 1.6 inches in one dimension D1 (shown in FIGS. 3E and 3F) and about 1.0 inch to about 1.3 inches or preferably about 1.2 inches in a second dimension D2 (shown in FIGS. 3D and 3F).

However, as discussed above, dimensions of the elongated body 12 can be selected by those skilled in the art based on the size of the firearm 110 being secured to the wearable device 10. In general, a total length of the elongated body 12 is slightly shorter (e.g., about 10%, 20% or 25%) shorter than a total length of a barrel of the firearm 110. The width of the elongated body 12 is generally slightly wider (e.g., about 10%, 20%, or 25% wider) than a width of the barrel of the firearm 110.

The elongated body 12 can be formed from various rigid and durable materials, which are sufficiently strong to support the firearm 110 without yielding or deforming. Also, the material is desirably lightweight so that it can be easily carried on the user's clothing without distracting the user or restricting his or her movement. For example, the elongated body 12 can comprise a suitable rigid plastic, such as polycarbonate.

As described above, the wearable device 10 further comprises the magnet 18 disposed in or adjacent to the top or shelf 20 of the upper portion 14 and configured to secure the firearm 110 to the elongated body 12. For example, the magnet 18 (shown in FIG. 4) can be positioned in a magnet port 38 with an open top end proximate to, substantially flush with, and/or extending through the shelf 20 of the upper portion 14. The magnet 18 can be positioned to secure or retain the rear (proximal) sight of the firearm 110 against the top surface or shelf 20 of the upper portion 14 of the elongated body 12 as shown, for example, in FIGS. 5A-5C. The magnet 18 can be any magnet capable of providing a magnetic field of sufficient strength to hold the firearm 110 in place against the top surface or shelf 20 of the elongated body 12 during one-handed reloading of the firearm 110. However, the magnet 18 should not be so strong as to prevent the firearm 110 from being easily removed from the shelf 20 of the elongated body 12 after reloading. In some examples, the magnet 18 can be one or multiple rare earth magnets, such as magnets comprising neodymium.

As shown in FIG. 2B, the wearable device 10 further comprises the clip 22 on the rear surfaces 24, 26 of the elongated body 12 for securing the wearable device 10 to the user's garment. For example, as discussed above, the clip 22 can comprise any sort of clip, bracket, button, or similar fastener for removably securing the wearable device 10 to the garment. In some examples, the clip 22 can comprise a Molle-Lok style attachment clip, which is made by Blade-Tech Industries, Inc. A Molle-Lok style clip comprises a spring loaded clip device configured for securing items to pockets, webbing, loops, or other attachment locations on a utility garment. In some examples, the clip 22 comprises a stationary member 40 secured to rear surfaces 24, 26 of the upper portion 14 and/or lower portion 16 of the elongated body 12, and an articulating member 42 configured to pivot relative to the stationary member 40 for securing a portion of the garment between the stationary member 40 and articulating member 42, thereof securing the wearable device 10 to the garment.

Figure 4:
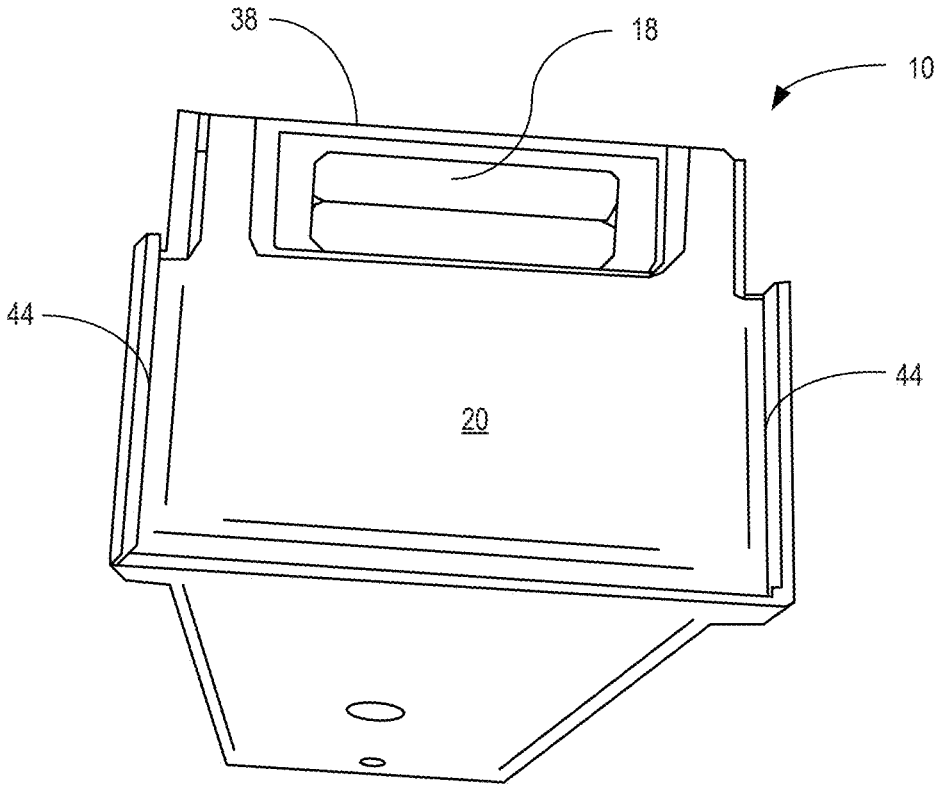
FIG. 4 is a perspective view showing a top portion of a wearable device for supporting a firearm during one-handed reloading, according to an aspect of the present disclosure.

In some examples, as shown in FIGS. 3A-3F and in FIG. 4, the elongated body 12 further comprises guides, such as protrusions or fins 44, that assist the user in positioning the proximal sight against the shelf 20 of the elongated body 12. For example, the elongated body 12 can comprise fins 44 extending upwards from right and left edges of the shelf 20 that indicate to the user where the proximal sight of the firearm 110 should be placed and assist the user in properly aligning the proximal sight relative to the shelf 20. The protrusions or fins 44 can be integrally molded with other portions of the elongated body 12 and formed from the same rigid plastic (e.g., polycarbonate) as other portions of the elongated body 12. In examples, the fins 44 can also be configured for stripping or for removing jammed cartridges from a firearm magazine. More particularly, in some examples, the protrusions or fins 44 can be configured for removing a double feed malfunction from the firearm 110 where a spent round remains stuck in a chamber of the firearm 110.

Figure 5A:
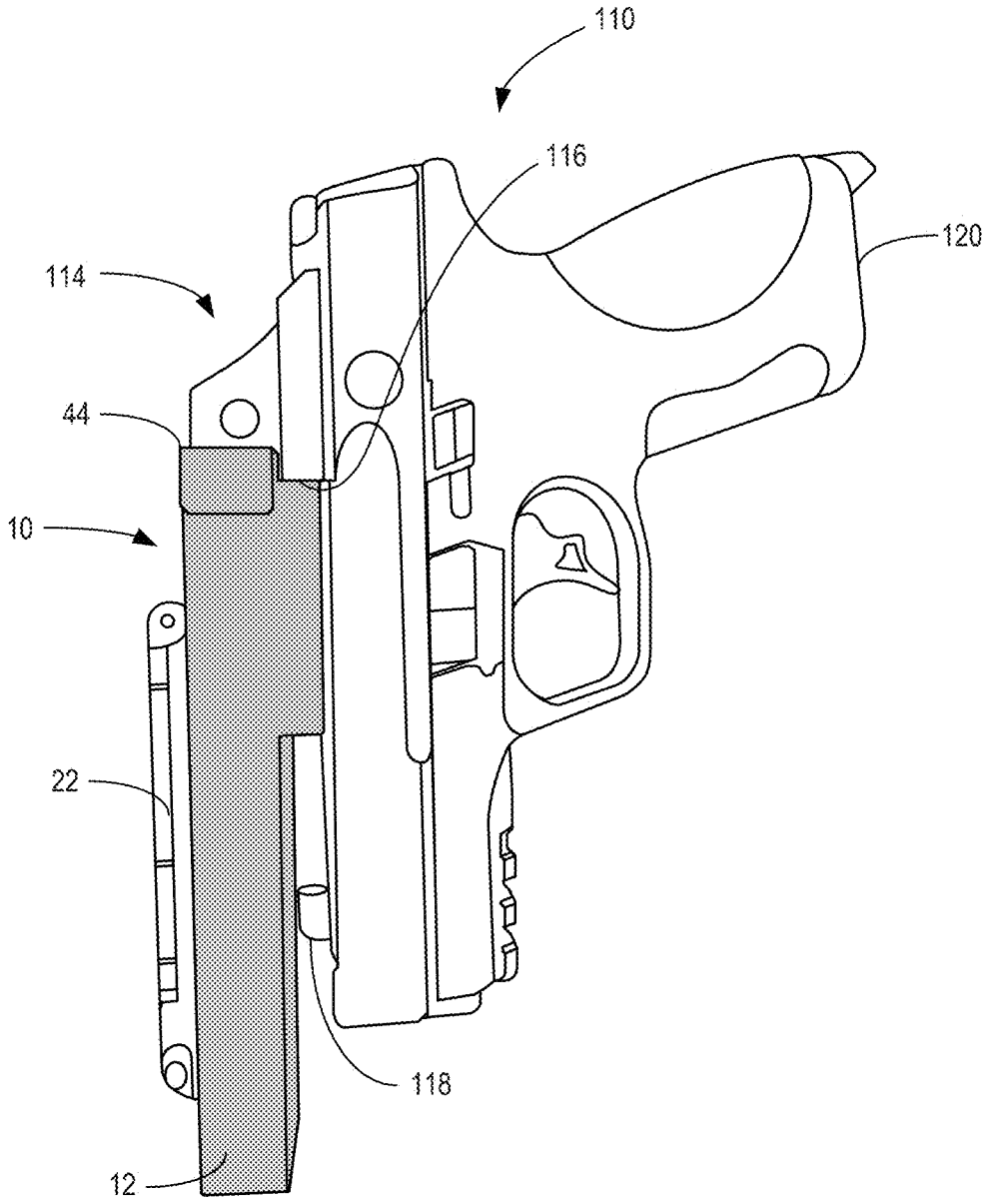
FIG. 5A is a side view showing a firearm mounted to a wearable device for supporting a firearm during one-handed reloading, according to an aspect of the present disclosure.
Figure 5B:
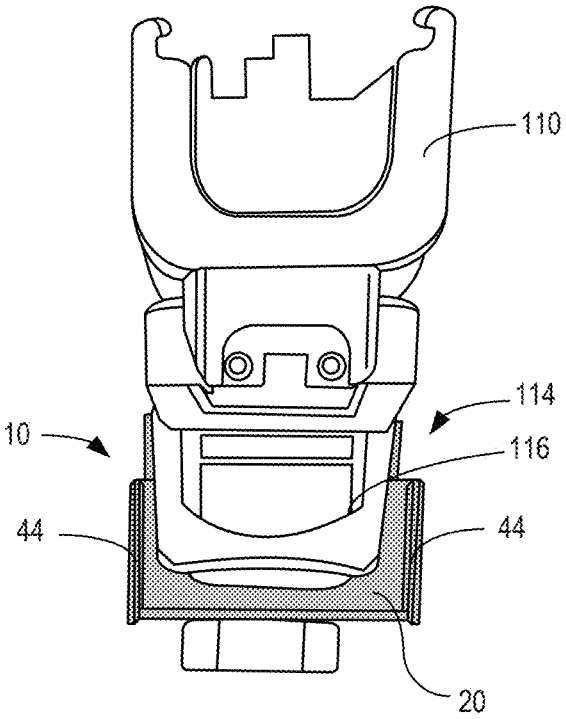
FIG. 5B is a top view showing a firearm mounted to a wearable device for supporting a firearm during one-handed reloading, according to an aspect of the present disclosure.
Figure 5C:
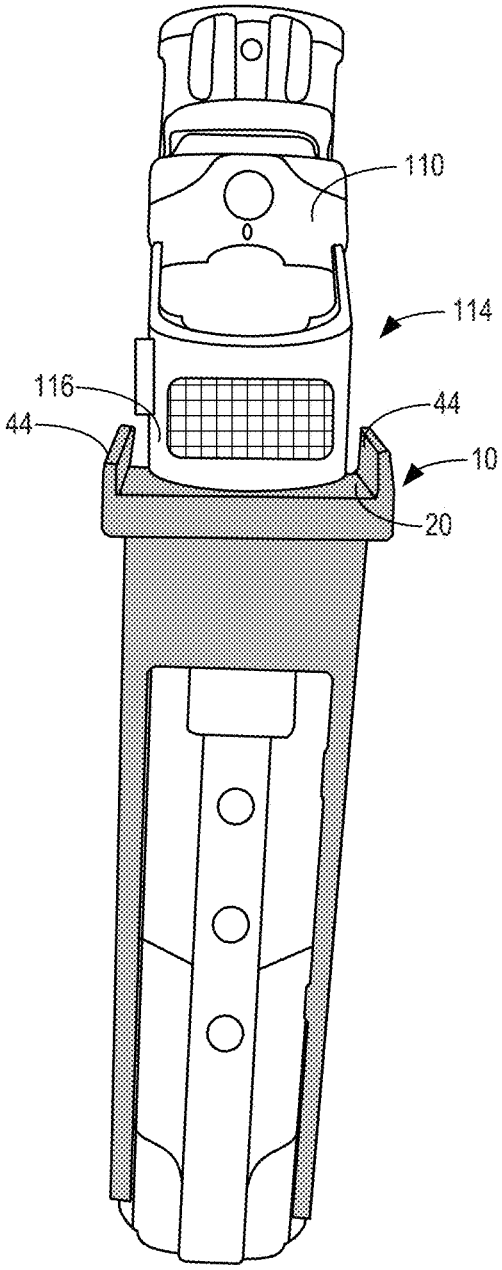
FIG. 5C is a rear view showing a firearm mounted to a wearable device for supporting a firearm during one-handed reloading, according to an aspect of the present disclosure.
Figure 6A:
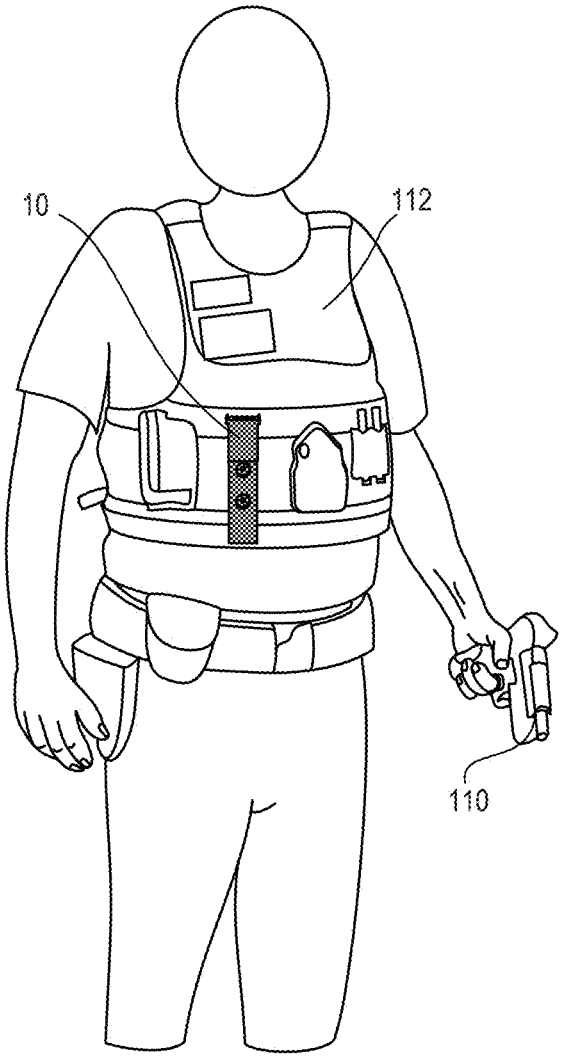
FIGS. 6A-6C are drawings showing a wearable device for supporting a firearm during one-handed reloading attached to a garment, such as a utility or police vest, according to aspects of the present disclosure.
Figure 6B:
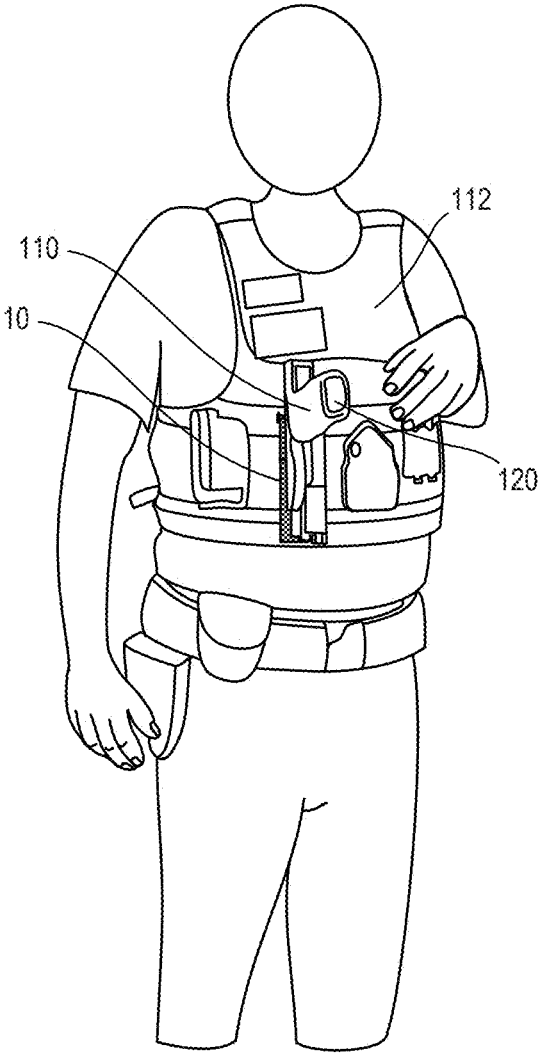
Figure 6C:
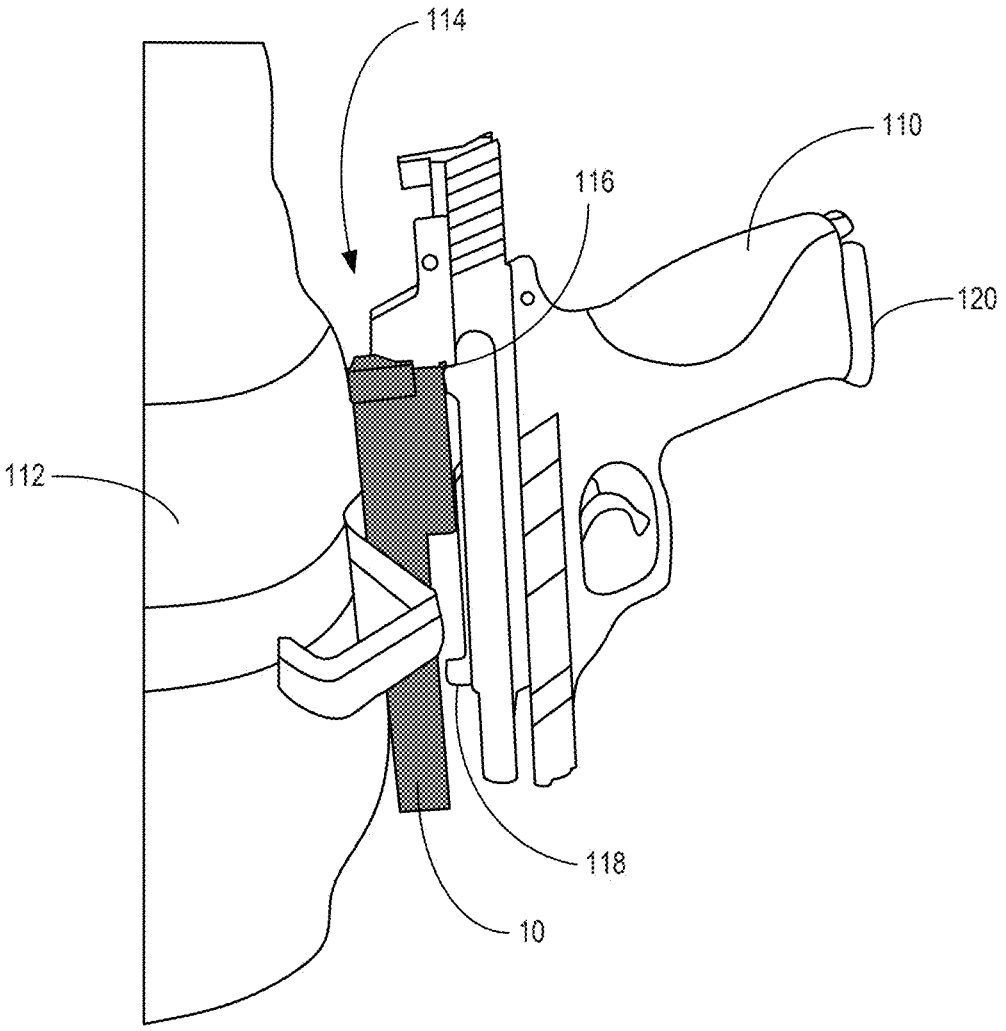

FIGS. 5A-5C are drawings showing the firearm 110 mounted to the wearable device 10. FIGS. 6A-6C are drawings showing the wearable device 10 and firearm 110 attached to a garment 112, such as a utility or police vest commonly worn by law enforcement officers, military personnel, and similarly trained individuals. In examples, the firearm 110 can be a pistol (e.g., a semi-automatic pistol) comprising a sight assembly 114 mounted to a barrel portion of the firearm 110, which comprises a rear (proximal) sight 116, which is configured to attach to the top or shelf 20 of the wearable device 10, and a front (distal) sight 118 spaced apart from the rear (proximal) sight 116. Exemplary sight assemblies and devices that can be adapted for use with the wearable device 10 of the present disclosure include red dot sights for pistols available from various manufacturers including Sellmark Corporation, Mansfield, TX, and others.

As discussed above, the wearable device 10 is desirably positioned on an accessible portion of the garment 112, within a wearer's workspace, and which is easily accessible by either hand. For example, as shown in FIG. 6A, the wearable device 10 can be positioned over the wearer's torso or abdomen slightly to the right of a centerline of the wearer's body. However, as discussed above, the wearer can position the wearable device 10 at any convenient location on the garment 112 based on the wearer's personal preference. The firearm 110 is shown attached to the wearable device 10 in FIGS. 5A-5C and in FIGS. 6B and 6C. As shown in these figures, the rear (proximal) sight 116 of the sight assembly 114 is positioned against the top surface or shelf 20 of the wearable device 10. The firearm 110 hangs downward, with the barrel of the firearm 110 generally parallel with a longitudinal axis of the elongated body 12 of the wearable device 10. Also, due to the thickness of the wearable device 10, the firearm 110 is spaced apart from the garment 112 preventing parts of the firearm 110, such as the front (distal) sight 118, from contacting, catching, or becoming attached to any portion of the garment 112 during reloading. In this position, a handle or grip of the firearm 110 is oriented away from the user. As used herein, "oriented away" means that a proximal end 120 (shown in FIGS. 5C and 6C) of the handle is positioned farther away from the user than either the wearable device 10 or other portions of the firearm 110. In fact, desirably, the proximal end 120 of the handle should be positioned as far away from the user's torso or abdomen as possible ensuring that the user is not hindered from grasping the handle of the firearm 110 by, for example, portions of the wearer's clothing and/or other accessories attached to the wearer's vest or garment 112.

Figure 7:
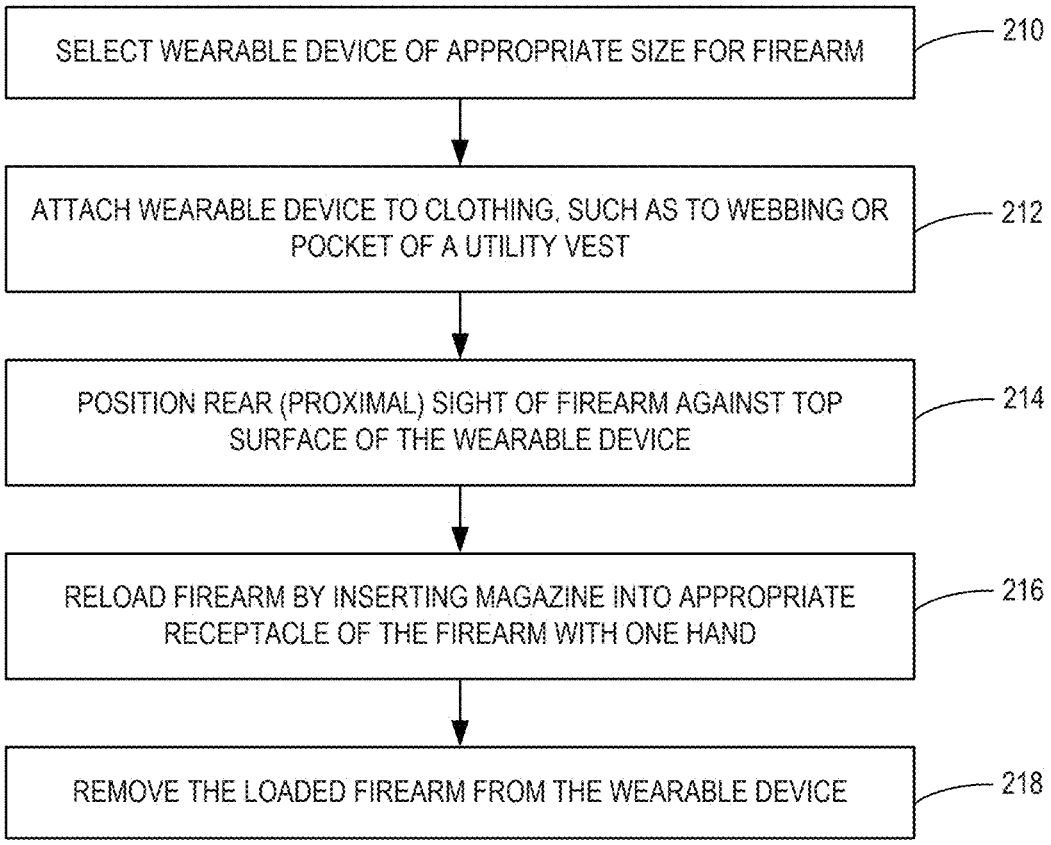
FIG. 7 is a flow chart showing a method for one-handed reloading of a firearm, according to an aspect of the present disclosure.

FIG. 7 is a flow chart showing a method for reloading a firearm 110 with one hand using the wearable device 10 of the present disclosure. At step 210, the method can comprise an initial step of selecting a wearable device 10 from a plurality of available wearable devices of different sizes so that a length of the selected wearable device 10 substantially matches a length of a barrel of the firearm 110 used by the individual or wearer. For example, as discussed above, a wearable device 10 suitable for use with a 9 mm semi-automatic pistol can be about 5.0 inches to about 8.0 inches in length. Wearable devices 10 for use with other types of pistols or firearms may have different dimensions.

Once a suitable wearable device 10 is selected, at step 212, the user can attach the wearable device 10 to his or her garment 112 with the clip 22. For example, the user can slide the articulating member 42 of the clip 22 through webbing, a pocket, or a similar attachment portion of the garment 112 in order to secure the wearable device 10 to the garment 112.

When ready to reload the firearm 110, at step 214, the user positions the rear (proximal) sight 116 of the sight assembly 114 of the firearm 110 against the top or shelf 20 of the elongated body 12, as shown in FIGS. 6B and 6C, guided by the protrusions or fins 44 extending upwards from the shelf 20. In this position, as previously described, the magnet 18 retains the proximal sight 116 against the shelf 20, thereby securing the firearm 110 against the elongated body 12, with the handle of the firearm 110 oriented away from the user. As previously described, when the firearm 110 is secured to the elongated body 12 in this manner, the firearm 110 is spaced apart from the garment 112 preventing parts of the firearm 110, such as the front (distal) sight 118, from contacting, catching, or becoming attached to a portion of the garment 112. Also, in this orientation, the user is not hindered from grasping the proximal end 120 of the firearm handle by other devices or accessories attached to the user's vest or garment 112.

At step 216, with the firearm 110 secured to the elongated body 12 of the wearable device 10, the user reloads the firearm 110 by inserting a new magazine into the appropriate receptacle of the firearm 110 with one hand. If the firearm 110 malfunctions or becomes jammed, the user can remove the malfunction using the protrusions or fins 44. Once the firearm 110 is correctly loaded and ready for use, at step 218, the user removes the loaded firearm 110 from the wearable device 10 by grasping the handle of the firearm 110 and pulling the firearm 110 away from the wearable device 10 with sufficient force to overcome the attracting force of the magnet 18.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. Furthermore, it is to be understood that the present invention contemplates that, to the extent possible, one or more features of any embodiment can be combined with one or more features of any other embodiment.

What is claimed is:

1. A wearable device for supporting a firearm during one-handed reloading, the wearable device comprising:

an elongated body comprising an upper portion and a recessed lower portion extending downward from the upper portion, the upper portion comprising a shelf configured to receive a proximal sight of the firearm for supporting the firearm against the elongated body;

at least one magnet disposed in or against the upper portion configured to retain the proximal sight against the shelf;

a magnet housing containing the at least one magnet and connected to the upper portion with an open top end of the magnet housing substantially flush with the shelf of the upper portion; and at least one clip on a rear surface of the elongated body for securing the wearable device to a garment of an individual.

2. The wearable device of claim 1, wherein the upper portion of the elongated body comprises the shelf, a front surface, a rear surface, and side surfaces extending between the front surface and the rear surface.

3. The wearable device of claim 2, wherein the lower portion of the elongated body comprises a front surface recessed relative to the front surface of the upper portion, a rear surface that is continuous with the rear surface of the upper portion, and side surfaces extending therebetween, which are continuous with the side surfaces of the upper portion.

4. The wearable device of claim 3, wherein a thickness of the lower portion between the front surface and the rear surface thereof is at least 0.25 inch less than a thickness of the upper portion between the front surface and the rear surface of the upper portion.

5. The wearable device of claim 1, wherein a length of the elongated body matches or substantially matches a length of a barrel of the firearm.

6. The wearable device of claim 1, wherein the lower portion is recessed relative to the upper portion by a distance corresponding to a height of a distal sight extending upwards from a barrel of the firearm.

7. The wearable device of claim 1, wherein the elongated body has a length between the shelf of the upper portion and a bottom surface of the lower portion of about 5 inches to about 8 inches.

8. The wearable device of claim 1, wherein the shelf of the upper portion is substantially rectangular with a length of about 1.5 inches to 2 inches in one dimension and about 1.0 inch to about 1.3 inches in a second dimension.

9. The wearable device of claim 1, wherein the magnet is positioned to secure the proximal sight of the firearm against the shelf of the upper portion of the elongated body with a handle of the firearm oriented away from the individual.

10. The wearable device of claim 1, wherein the at least one clip comprises a stationary member secured to rear surfaces of the upper and/or lower portions of the elongated body, and an articulating member configured to pivot relative to the stationary member for securing a portion of the garment between the stationary member and articulating member, thereof securing the wearable device to the garment.

11. A wearable device for supporting a firearm during one-handed reloading, the wearable device comprising:

an elongated body comprising an upper portion and a recessed lower portion extending downward from the upper portion, the upper portion comprising a shelf configured to receive a proximal sight of the firearm for supporting the firearm against the elongated body;

at least one magnet disposed in or against the upper portion configured to retain the proximal sight against the shelf;

at least one clip on a rear surface of the elongated body for securing the wearable device to a garment of an individual; and at least one guide fin extending upwards from the shelf of the upper portion of the elongated body.

12. The wearable device of claim 11, further comprising a magnet housing containing the at least one magnet and connected to the upper portion with an open top end of the magnet housing substantially flush with the shelf of the upper portion.

13. A wearable device for supporting a firearm during one-handed reloading, the wearable device comprising:

an elongated body comprising an upper portion and a recessed lower portion extending downward from the upper portion, the upper portion comprising a shelf configured to receive a proximal sight of the firearm for supporting the firearm against the elongated body;

at least one magnet disposed in or against the upper portion configured to retain the proximal sight against the shelf;

at least one clip on a rear surface of the elongated body for securing the wearable device to a garment of an individual;

a first guide fin extending upwards from a right edge of the shelf; and a second guide fin extending upwards from a left edge of the shelf.

14. The wearable device of claim 13, wherein the first guide fin and the second guide fin are configured to guide the proximal sight to the shelf for supporting the firearm.

15. The wearable device of claim 14, wherein the first guide fin and the second guide fin are configured for removing a double feed malfunction from the firearm where a spent round remains stuck in a chamber of the firearm.

16. A method for one-handed reloading of a firearm, the method comprising:

attaching a wearable device to a garment of an individual with at least one clip, wherein the wearable device comprises:

an elongated body comprising an upper portion and a recessed lower portion extending downward from the upper portion, the upper portion comprising a shelf configured to receive a proximal sight of the firearm for supporting the firearm against the elongated body;

at least one magnet disposed in or against the upper portion configured to retain the proximal sight against the shelf; and the at least one clip on a rear surface of the elongated body for securing the wearable device to the garment of the individual;

positioning the proximal sight of the firearm against the shelf of the upper portion with the at least one magnet retaining the proximal sight against the shelf, thereby securing the firearm to the elongated body; and with the firearm secured to the elongated body, reloading the firearm with one hand.

17. The method of claim 16, wherein the firearm is secured to the elongated body with a handle of the firearm oriented away from the individual.

18. The method of claim 16, further comprising selecting the wearable device from a plurality of available wearable devices of different sizes so that a length of the selected wearable device substantially matches a length of a barrel of the selected firearm.

19. The method of claim 16, wherein when the firearm is secured to the elongated body, the firearm is spaced apart from the garment preventing the firearm from contacting or attaching to a portion of the garment.

20. A wearable garment comprising the wearable device of claim 1 secured to the garment by the at least one clip.

* * * * *